US006661992B2

(12) United States Patent
Lee

(10) Patent No.: US 6,661,992 B2
(45) Date of Patent: Dec. 9, 2003

(54) FUSING ROLLER FOR AN ELECTROPHOTOGRAPHIC IMAGE FORMING APPARATUS HAVING QUICK WARM UP TIME AND UNIFORM TEMPERATURE DISTRIBUTION

(75) Inventor: Kyung-woo Lee, Suwon-si (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/270,052

(22) Filed: Oct. 15, 2002

(65) Prior Publication Data

US 2003/0095820 A1 May 22, 2003

(30) Foreign Application Priority Data

Nov. 16, 2001 (KR) ..... 2001-71399

(51) Int. Cl.[7] ..... G03G 15/20

(52) U.S. Cl. ..... 399/330; 219/216; 219/469; 432/60

(58) Field of Search ..... 399/330, 334; 219/216, 469, 471; 430/60

(56) References Cited

U.S. PATENT DOCUMENTS 3,952,798 A * 4/1976 Jacobson et al. ..... 219/471
4,743,940 A * 5/1988 Nagasaka et al. ..... 399/330
4,791,275 A 12/1988 Lee et al.
6,336,027 B1 1/2002 Sakai et al.
2002/0118984 A1 8/2002 Lee et al.
2002/0118985 A1 8/2002 Lee

FOREIGN PATENT DOCUMENTS

JP 9-197863 A * 7/1997
JP 2000-29332 1/2000

OTHER PUBLICATIONS

*"Notice of the reason of rejection" issued by Korean Industrial Property Office dated on Jun.* 25, 2003.

* cited by examiner

*Primary Examiner*—Joan Pendegrass
(74) *Attorney, Agent, or Firm*—Robert E. Bushnell, Esq.

(57) ABSTRACT

A fusing roller of an electrophotographic image forming apparatus is provided. The fusing roller includes an internal pipe having enclosed both ends in which a vacuum state of predetermined pressure is maintained and a predetermined amount of working fluid is stored, a fusing portion installed to surround the internal pipe, and a heating portion comprised of a helical resistance heating coil which is installed between the fusing portion and the internal pipe and generates heat. The distance between windings becomes smaller at the ends of the fusing roller than at the center to compensate for the higher dissipation of heat at the ends of the fusing roller than at the center. The result is a fusing roller that can quickly heat up and that has a uniform temperature along the surface of the fusing roller from end to end.

25 Claims, 4 Drawing Sheets

FUSING ROLLER FOR AN ELECTROPHOTOGRAPHIC IMAGE FORMING APPARATUS HAVING QUICK WARM UP TIME AND UNIFORM TEMPERATURE DISTRIBUTION

CLAIM OF PRIORITY

This application makes reference to, incorporates the same herein, and claims all benefits accruing under 35 U.S.C. §119 from my application entitled FUSING ROLLER OF ELECTROPHOTOGRAPHIC IMAGE FORMING APPARATUS filed with the Korean Industrial Property Office on Nov. 16, 2001 and there duly assigned Serial No. 2001-0071399.

BACKGROUND OF THE INVENTION

1. Field of the Invention

The present invention relates to a fusing roller in an electrophotographic image forming apparatus, and more particularly, to a design for a fusing roller used in an electrophotographic image forming apparatus that minimizes a surface temperature gradients over the surface of the fusing roller.

2. Description of the Related Art

Designs of fusing roller units adopting a heat pipe capable of instantaneously heating the fusing roller due to high heat conductivity an having low power consumption are disclosed in Japanese Patent Publication Nos. Hei 5-135656, Hei 10-84137, Hei 6-29663, and Hei 10-208635. Such fusing roller units adopting the heat pipe have a structure in which heat sources having different shapes are provided at one side end of the fusing roller unit deviating from a fusing region. In the arrangement structure of heat sources, the overall length of the fusing roller unit may be enlarged, and thus structural complication should be improved.

Also, the fusing roller units disclosed in Japanese Patent Publication Nos. Sho 58-163836, Hei 3-107438, Hei 3-136478, Hei 6-316435, Hei 7-65878, and Hei 7-105780, and Hei 7-244029 have a structure in which heat sources are provided inside the fusing rollers, and thus the above-mentioned enlargement of the overall length does not occur. However, the fusing roller units have a plurality of partial heat pipes, and thus processing and manufacturing of the fusing roller units are very complicated.

Further, the heat pipes are arranged partially in the fusing roller units, and thus a temperature difference between a portion among the heat pipes and a portion contacting the heat pipes occurs. When a temperature difference occurs in the fusing roller, ink such as toner, is not properly transferred onto the paper, degrading printing quality.

Serial Nos. 60/257,118, 09/947,657 and 09/967,934 teach a fusing roller that has a resistive heating element wound about the fusing roller in a spiral fashion. Near the axis of the fusing roller is a heat pipe comprising a working fluid and a wick. Although this design of a fusing roller enables the fusing roller to be heated quickly, the surface of the fusing roller has an unwanted temperature gradient along the length of the fusing roller. When recently heated, the center portion of the fusing roller is at a higher temperature than the surface of the fusing roller near the ends of the fusing roller.

What is needed is a design for a fusing roller that eliminates these temporary temperature gradients along the length of the surface of the fusing roller by compensating for the temperature gradients along the length of the surface of the fusing roller.

SUMMARY OF THE INVENTION

It is therefore an object of the present invention to provide a design for a fusing roller used in an electrophotographic image forming apparatus, the fusing roller including a heating portion having an improved structure in which the above-referenced surface temperature gradients of the fusing roller can be minimized, and thus a high quality fusing of the toner image can be achieved with minimal warm up times.

To achieve the above object, according to one aspect of the present invention, there is provided a novel design for a fusing roller used in an electrophotographic image forming apparatus. The fusing roller includes an internal pipe having enclosed both ends in which a vacuum state of predetermined pressure is maintained and a predetermined amount of working fluid is stored, a fusing portion installed to surround the internal pipe, and a heating portion comprised of a resistance heating coil which is installed between the fusing portion and the internal pipe and generates heat. In order to compensate for the roll off in temperatures near the ends of the fusing roller, the resistive heating element near the end portions of the fusing roller are spaced closer together than at the center of the fusing roller.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
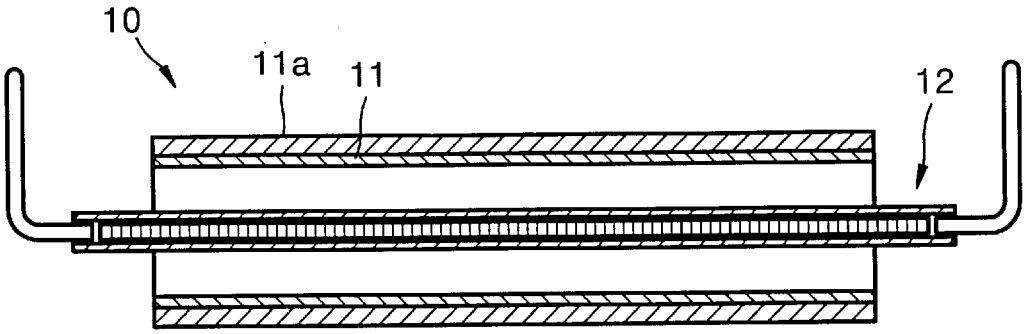
FIG. 1 (PRIOR ART)
FIG. 1 is a latitudinal cross-sectional view of a fusing roller unit of an electrophotographic image forming apparatus in which a halogen lamp is used as a heat source.

FIG. 1 is a latitudinal cross-sectional view of a fusing roller unit used in an electrophotographic image forming apparatus where a halogen lamp is used as the heat source. Referring to FIG. 1, a fusing roller unit 10 includes a cylindrical fusing roller 11 having a heating portion 12, such as halogen lamp installed along the axis of the fusing roller 11. A coating layer 11*a* formed of Teflon or the like is formed on the surface of the fusing roller 11. The heating portion 12 generates heat from the inside of the fusing roller 11, and the fusing roller 11 is heated by the radiant heat generated by the heating portion 12 from the inside of the fusing roller 11.

Figure 2:
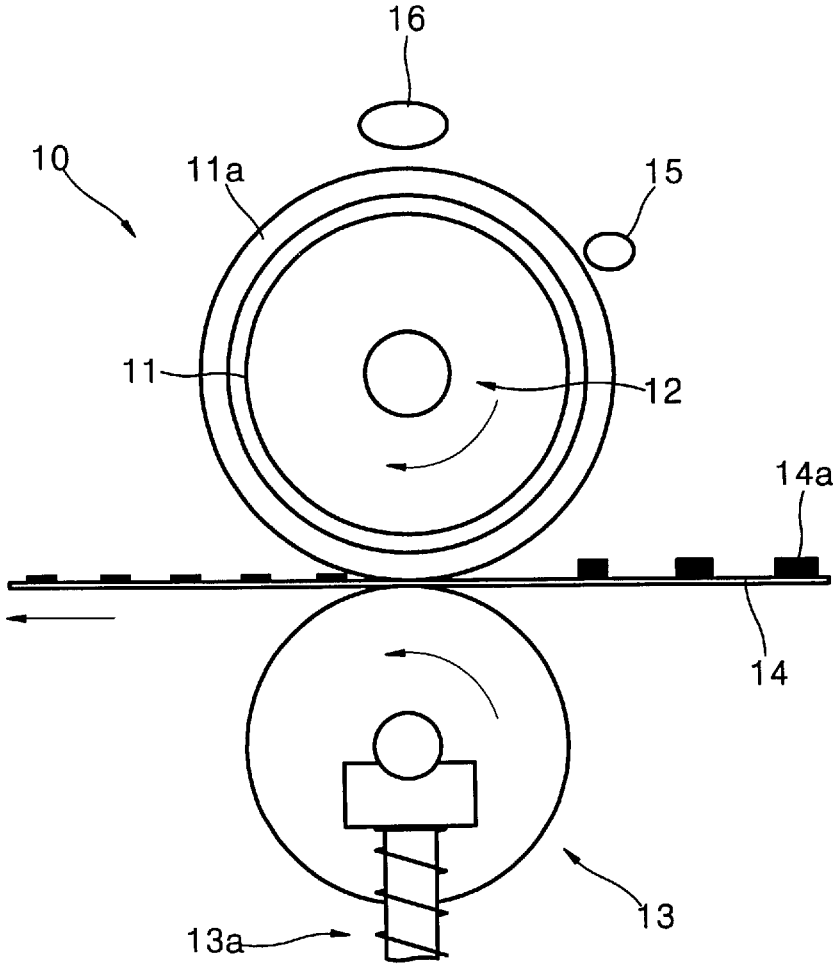
FIG. 2 (PRIOR ART)
FIG. 2 is a longitudinal cross-sectional view illustrating the relationship between the fusing roller unit and a pressure roller of an electrophotographic image forming apparatus in which the halogen lamp shown in FIG. 1 is used as a heat source.

FIG. 2 is a longitudinal cross-sectional view illustrating the relationship between the fusing roller unit 10 and a pressure roller 13 in an electrophotographic image forming apparatus where the halogen lamp illustrated in FIG. 1 is used as a heat source. Referring to FIG. 2, pressure roller 13 is disposed under the fusing roller unit 10 to be opposite to the fusing roller unit 10 in which a paper 14 is placed between the fusing roller unit 10 and the pressure roller 13. The pressure roller 13 is supported elastically by a spring unit 13*a* and applies predetermined pressure to the paper 14 passing between the fusing roller unit 10 and the pressure roller 13.

In FIG. 2, a powdered toner image 14*a* is formed on the paper 14, and the paper 14 is pressed and heated by the predetermined pressure and is heated while passing between the fusing roller unit 10 and the pressure roller 13. This heat and pressure causes the toner image 14*a* to be fused on the paper 14.

One drawback of using a halogen lamp as a heating source is that there is much unnecessary power consumption by the fusing roller unit 10 in which a halogen lamp is used as a heat source. This is manifested by longer warm-up times after the power is turned off and is turned back on again to form images. In addition, since the fusing roller 11 is heated by radiant heat generated by the heating portion 12 installed along the axis of the fusing roller 11, the heat transfer speed of the fusing roller unit 10 using this halogen lamp is slow. Also, the compensation of temperature changes caused by contact with the paper 14 is slow, making it difficult to control the distribution of temperature on the surface of the fusing roller thereby degrading the quality of an image. In addition, an image cannot be printed quickly after the printer has been powered down because of the long warm up time.

Figure 3:
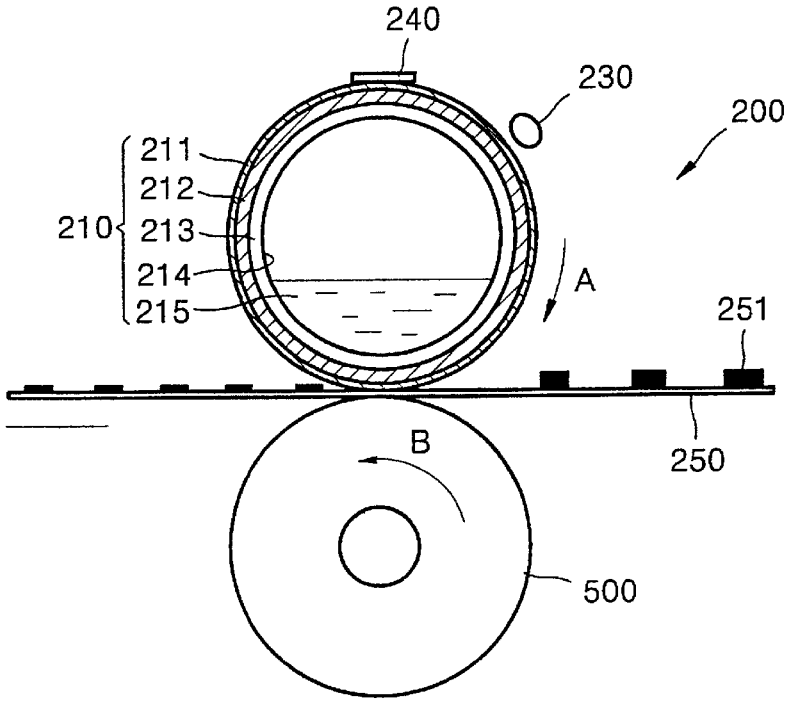
FIG. 3 is a longitudinal cross-sectional view of a fusing unit according to the present invention.
Figure 4:
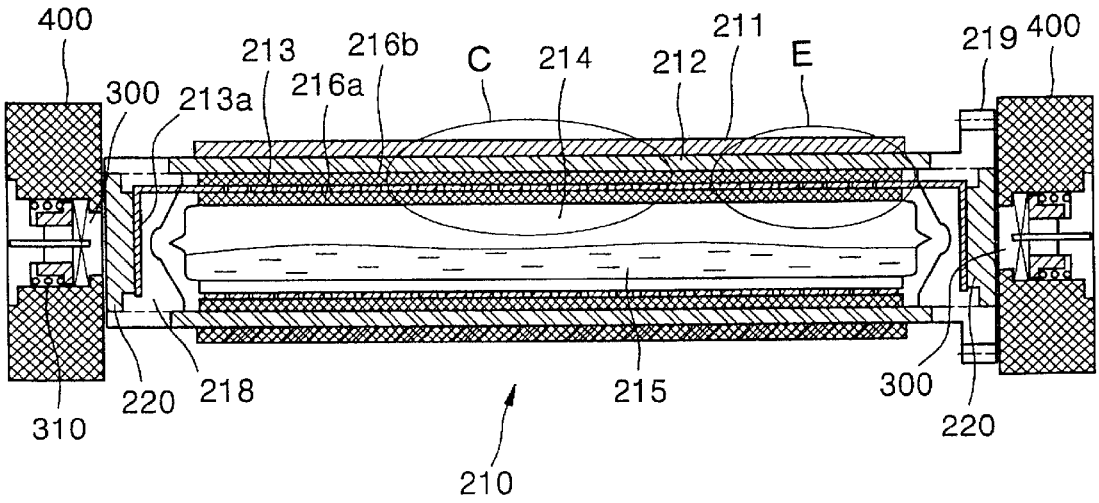
FIG. 4 is a latitudinal cross-sectional view illustrating the structure of a fusing roller shown in FIG. 3.

FIG. 3 is a longitudinal cross-sectional view of a fusing unit according to the present invention, and FIG. 4 is a latitudinal cross-sectional view illustrating the structure of a fusing roller illustrated in FIG. 3. Referring to FIGS. 3 and 4, a fusing unit 200 used in an electrophotographic image forming apparatus according to the present invention includes a fusing roller 210 which rotates in a direction in which a paper 250 on which a toner image 251 is formed is conveyed. Thus, fusing roller 210 rotates in the direction indicated by arrow A and pressure roller 500 rotates in a direction indicated by arrow B so that fusing roller 210 and pressure roller 500 form a nip that conveys paper 250 from right to left in FIG. 3.

The fusing roller 210 includes a cylindrical fusing portion 212 in which a protection layer 211 formed by coating Teflon on its surface is formed, a heating portion 213 which is installed inside the fusing portion 212 and generates heat due to current applied from a power supply portion 300, and an internal pipe 214 having an enclosed internal space, in which predetermined pressure is maintained. A first insulating layer 216*a* is interposed between the heating portion 213 and the internal pipe 214, and a second insulating layer 216*b* is interposed between the heating portion 213 and the fusing portion 212.

In an embodiment of the present invention, preferably, the first insulating layer 216*a* and the second insulating layer 216*b* are mica. The first insulating layer 216*a* and the second insulating layer 216*b* are optional and may be not formed. Preferably, a net-shaped wick structure is provided inside the internal pipe 214 to enable the working fluid 215 inside pipe 214 to evaporate and condense as described in Serial Nos. 60/257,118, 09/947,657 and 09/967,934 to more evenly heat the surface 211 of the fusing roller. Of course, various modifications in which heat can be uniformly transferred to the entire portion of the internal pipe 214 may be possible.

Working fluid 215 is stored in the internal pipe 214 at a predetermined volume ratio. Also, the power supply portion 300 in frame 400, power supply portion being connected to an external power supply (not shown) for supplying current to the heating portion 213. A thermistor 230 which contacts the protection layer 211 and senses the surface temperature of the fusing portion 212 and the protection layer 211, and thermostat 240 which prevents overheat of the fusing portion 212 by cutting power from the power supply portion 300 when the surface temperature of the fusing portion 212 and the protection layer 211 rapidly increases, are installed on the fusing portion 212.

An end cap 218 for enclosing inside the fusing roller 210 and a gear cap 219 having an additional power transmission device (not shown) are provided at both ends of the fusing roller 210. Thus, the fusing roller 210 rotates by the gear cap 219 connected to the power transmission device. Preferably, the gear cap 219 and the power transmission device are constituted by smoothly-engaged gears.

An electrode 220 for applying current supplied from an external power to the heating portion 213 is installed in the end cap 218. One side of the electrode 220 is electrically connected to the heating portion 213 by a lead portion 213*a*, and the other side of the electrode 220 is electrically connected to the power supply portion 300. Since the power supply portion 300 adheres to the electrode 220 through an elastic member 310, even through the fusing portion 212 rotates, the electrode 220 continuously contacts the power supply portion 300, and the current supplied from the power supply portion 300 is applied to the heating portion 213 through the electrode 220 and the lead portion 213*a*.

The heating portion 213 generates heat such that the temperature of the fusing portion 212 increases to a fusing target temperature so as to fuse the toner image 251 on the paper 250 by the current supplied from an external power source, heating portion 213 being preferably formed of a resistance heating coil. The resistance heating coil has a helical shape or a ribbon shape and may be formed of molybdenum (Mo) or tungsten (W), or alloy of iron-chrome (Fe—Cr), or alloy of nickel-chrome (Ni—Cr), or alloy of copper-nickel (Cu—Ni). The resistance of the resistance heating coil is 4–20 Ω/m, and its volume resistivity is 0.4–1.55 $\mu\Omega\cdot$m. The resistance heating coil is installed to be wound around the internal pipe 214 in a spiral such that a predetermined separated space D is formed between adjacent heating coils.

Figure 5:
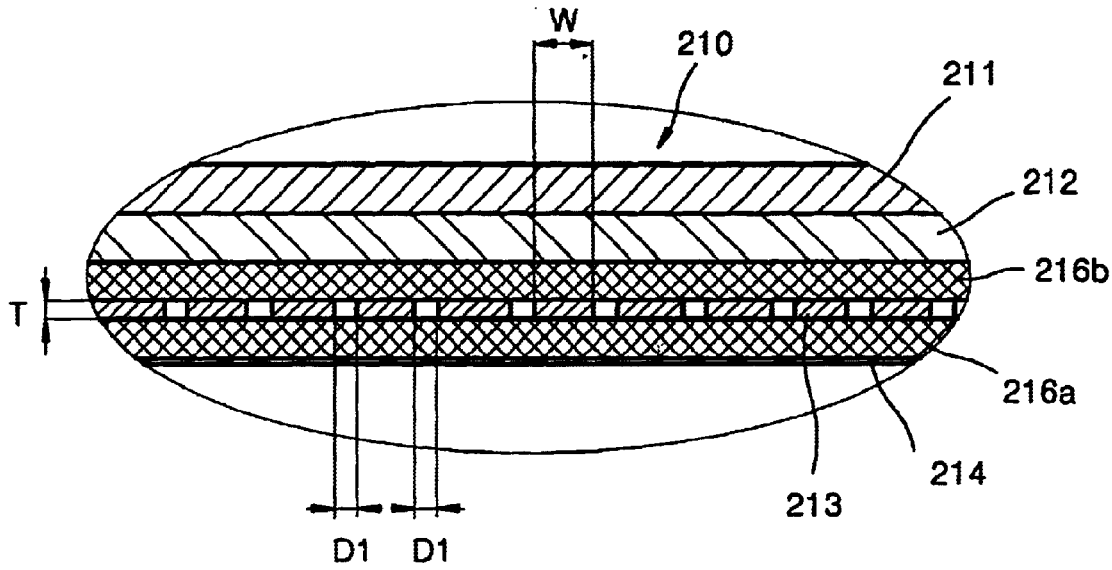
FIG. 5 is an enlarged view of a center portion C illustrated in FIG. 4.
Figure 6:
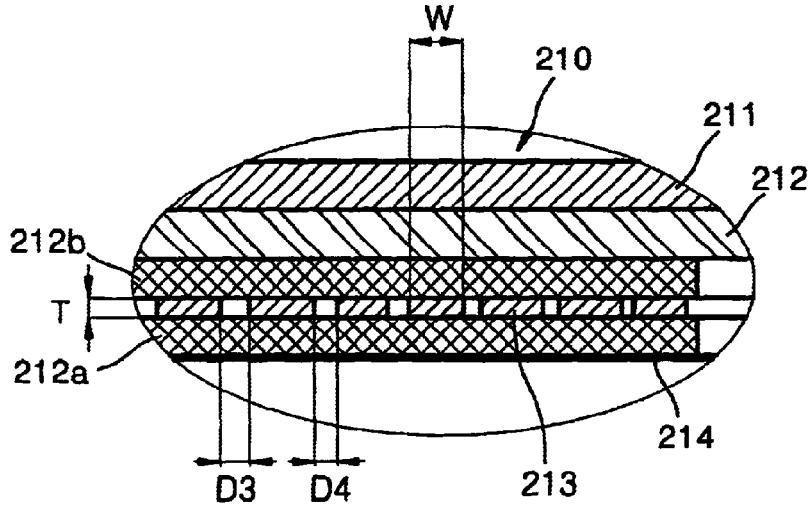
FIG. 6 is an enlarged view of an end portion E illustrated in FIG. 4.

FIG. 5 is an enlarged view of a center portion C illustrated in FIG. 4, and FIG. 6 is an enlarged view of an end portion E illustrated in FIG. 4. In both FIGS. 5 and 6, resistance heating coil 213 has a width W and a thickness T at all locations on the fusing roller. In other words, in this embodiment of the present invention, the width W of resistance heating coil 213 is constant and the thickness T is constant.

In this embodiment of the present invention, the distance D separating adjacent windings varies near each end of the fusing roller. Referring to FIG. 5, the distance D1 between adjacent windings is constant throughout section C of FIG. 4. However, in FIG. 6, the distance D between adjacent windings progressively decreases in section E of FIG. 4. In FIG. 6, D4 is less than D3 as D4 is closer to an end of the fusing roller than D3. Since the width W of resistive heating coil 213 in this embodiment is always constant, changes to the distance D between adjacent coils results in changes in pitch between adjacent winding as the pitch is equal to the sum of the width W and the distance between a pair of adjacent windings D. Thus, in this embodiment, both the distance D between adjacent windings and the pitch of each winding progressively gets smaller towards the ends of the roller while the thickness, composition and width of the heating coil remains the same.

Figure 7:
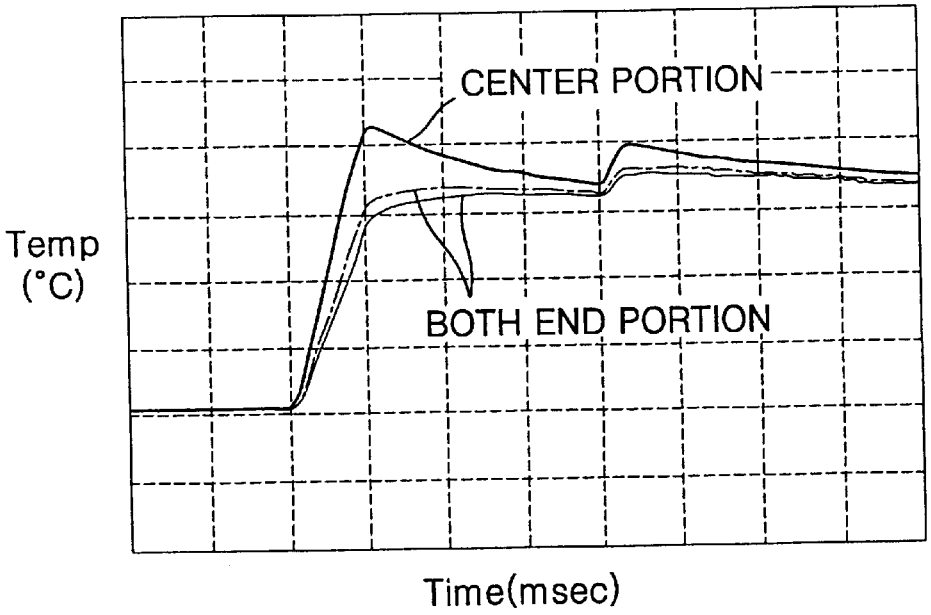
FIG. 7 is a graph illustrating empirical data of the temperature with respect to time of the surface of the fusing roller both near the ends and near the center of the fusing roller when the distance between adjacent winds of the heater resistive element is uniform and constant along the entire length of the fusing roller.

FIG. 7 is a graph illustrating temperature with respect to time at different points on the fusing roller when the distance D between adjacent coils of the resistive heating element 213 is constant and thus the pitch is constant from end to end on the fusing roller. Referring to FIG. 7, if the temperature of the fusing portion 212 is empirically measured when the distance between adjacent coils and pitch are constant from end to end, the surface temperature at the end portions of the fusing roller are initially cooler than the surface temperature at the center portion of the fusing roller. This is because the amount of heat dissipated at the end portions of the fusing roller 210 is greater than the amount of heat dissipated from the center portion of the fusing roller. Thus, even though the heat produced by resistive heating element 213 along the axis of the fusing roller is uniform, the temperature measured at both ends of the fusing roller 210 is lower than the temperature measured at the center portion of the fusing roller 210.

Figure 8:
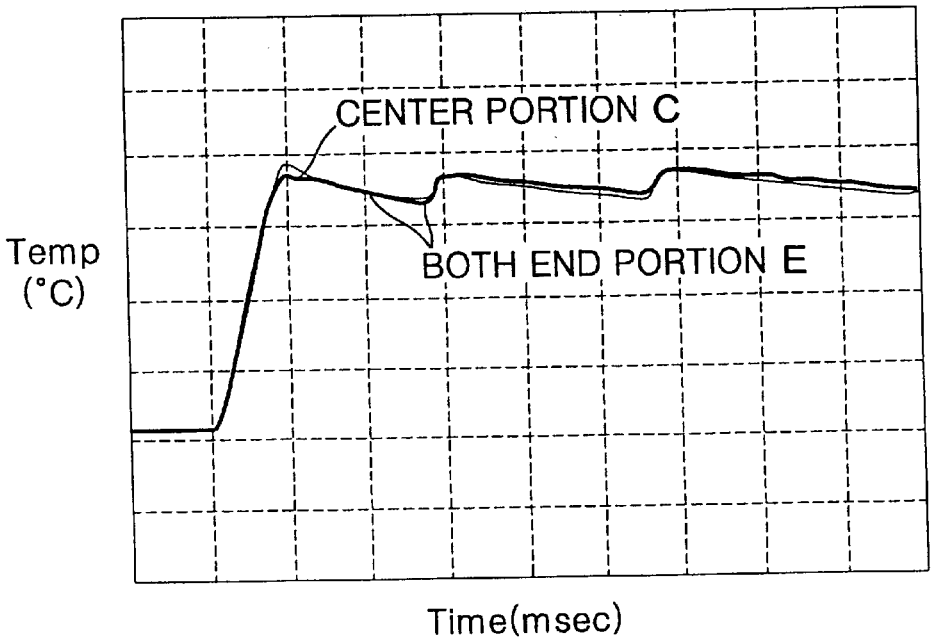
FIG. 8 is a graph illustrating empirical data of the temperature with respect to time of the surface of the fusing roller both near the ends and near the center of the fusing roller when the distance between adjacent winds of the heater resistive element is smaller near the ends of the heating roller than at the center of the heating roller.

FIG. 8 is a graph illustrating temperature with respect to time at different points on the fusing roller when the distances between adjacent coil windings and the pitches become progressively smaller towards the ends of the fusing roller. Referring to FIG. 8, if the temperature of the fusing portion 212 is measured when the distances between adjacent coils of a resistance heating element 213 become progressively smaller at the ends of the fusing roller, the empirically measured temperature at each end portion of the fusing roller 210 is about the same as the temperature measured at the center portion of the fusing roller 210. By spacing the coils closer to one another at the end portions of the fusing roller, more heat is generated at the end portions than at the center of the fusing roller. Since more heat is also dissipated at the end portions of the fusing roller, this increased generation of more heat at the end portions of the fusing roller balances out the increase in dissipation of heat at the end portions, resulting in the temperature at the end portions of the fusing roller to be equal to the temperature at the center portion of the fusing roller. Since the temperature is now uniform along the entire length of the fusing roller, better quality printing is achieved while benefitting from a quick warm up time of the fusing roller.

As described above, in the fusing roller used in an electrophotographic image forming apparatus according to the present invention, the distance between coils become progressively smaller at the ends of the fusing roller, thereby resulting in a uniform temperature along the entire length of the fusing roller at all times after power is applied to the fusing roller. Therefore, high image quality and quick warm up times can now be achieved by using the above design for a fusing roller.

Although the present invention seeks to compensate for increased heat dissipation at the ends of the fusing roller by solely adjusting the space between adjacent coils of a resistive heating element at the ends of a fusing roller, it is to be appreciated that this invention is not limited solely to this form of heat compensation. It is to be appreciated that the heating resistance coil 213 can be made thinner and/or narrower at the ends of the fusing roller than at the center of the fusing roller while keeping the pitch between adjacent coils the same throughout the length of the fusing roller. Alternatively, the heating resistance coil can be made of a material having a higher resistivity at the end portions of the fusing roller than at the center of the fusing roller. In addition, it can be appreciated that a combination of 1) decreasing the space between adjacent coils, 2) decreasing the width of the heating resistive element, 3) reducing the thickness of the heater resistive element at the ends of the fusing roller and/or 4) using a different and higher resistivity material as the heater resistive element at the ends of the fusing roller than used in the center of the fusing roller can all be applied in combination to compensate for the increased amount of heat dissipation at the ends of the fusing roller than at the center of the fusing roller. A further embodiment is contemplated where the pitch of the coil and the distance between windings is smaller at the ends of the roller than at the center, where the pitch and the distance between windings of the coil at the end portions are constant as opposed to becoming progressively smaller.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A fusing roller for an electrophotographic image forming apparatus, comprising:

an internal pipe being hermetically sealed and having a working fluid stored within;

a fusing portion installed to surround the internal pipe; and a heating portion comprised of a helical resistance heating coil which is installed between the fusing portion and the internal pipe to generate heat, distances between adjacent coils being smaller at ends of the fusing roller than at the center of the fusing roller.

2. The fusing roller of claim 1, said distances between adjacent coils of said resistance heating coil become progressively smaller towards the ends of the fusing roller.

3. The fusing roller of claim 2, said resistance heating coil having a width and a thickness that do not vary along a length of the fusing roller.

4. The fusing roller of claim 3, the resistance heating coil being made of a homogenous material along the length of the fusing roller.

5. The fusing roller of claim 1, pitches of said heating coil become progressively smaller towards said ends of said fusing roller while a thickness, width and composition of the heating coil remain uniform at all locations on said fusing roller.

6. The fusing roller of claim 1, pitches of said heating coil become smaller at said ends of said fusing roller by varying in a stepwise fashion near said ends of said fusing roller while a thickness, width and composition of the heating coil remain uniform at all locations on said fusing roller.

7. A fusing roller for an electrophotographic image forming apparatus, said fusing roller having two end portions and a center portion disposed in between said two end portions, said heating roller comprising:

a hermetically sealed internal pipe having a working fluid therein along a length of the fusing roller;

a resistive heater wrapped in a spiral around the pipe, a distance between adjacent windings of the resistive heater being smaller at said two end portions than at said center portion of the fusing roller; and a fusing portion disposed around the resistive heater.

8. The fusing roller of claim 7, further comprising:

a first insulating layer disposed between said resistive heater and said pipe; and a second resistive heater disposed between said resistive heater and said fusing portion.

9. The fusing roller of claim 8, said first and said second insulating layer being comprised of mica.

10. The fusing roller of claim 7, further comprising a power supply portion electrically connected to said resistive heater to heat said resistive heater.

11. The fusing roller of claim 9, said fusing portion being encapsulated by a Teflon layer.

12. The fusing roller of claim 7, said resistive heater being selected from a group consisting of molybdenum, tungsten, an alloy of iron-chrome (Fe—Cr), an alloy of nickel-chrome (Ni—Cr) and an alloy of copper-nickel (Cu—Ni).

13. The fusing roller of claim 12, said resistive heater having a resistivity of 4–20 Ω/m.

14. The fusing roller of claim 12, said resistive heater having a volume resistivity of 0.41.55 $\mu\Omega$m.

15. The fusing roller of claim 7, said resistive heater having a uniform and constant width, thickness and composition throughout said fusing roller.

16. The fusing roller of claim 7, a pitch of said resistive heater from winding to winding being smaller at the ends of the fusing roller than at the center of the fusing roller.

17. The fusing roller of claim 15, pitches of said heater becoming progressively smaller at said end portions of said fusing roller.

18. The fusing roller of claim 15, pitches of said heater varying in a step fashion from said center portion to said end portions of said fusing roller, pitches in said end portion being smaller than pitches in said center portion.

19. A fusing roller for an electrophotographic image forming apparatus, comprising:

an internal pipe being hermetically sealed and having a working fluid stored within;

a fusing portion installed to surround the internal pipe; and a heating portion comprised of a helical resistance heating coil which is installed between the fusing portion and the internal pipe to generate heat, said heating portion generating more heat per unit length of said fusing roller at two end portions of said fusing roller than at a center portion of said fusing roller.

20. The fusing roller of claim 19, said heating portion being made of a higher resistive material at said end portions than at said center portion.

21. The fusing roller of claim 19, said heating portion being made thinner at said end portions than at said center portion.

22. The fusing roller of claim 19, said heating portion being made narrower at said end portions than at said center portion.

23. The fusing roller of claim 19, said heating portion being made of a higher resistive material at said end portions than at said center portion, a thickness, a width, a distance between adjacent windings and a pitch of said heating portion all being uniform along an entire length of said fusing roller.

24. The fusing roller of claim 19, said heating portion being made thinner at said end portions than at said center portion, a width, a distance between adjacent windings, a pitch and a composition of said heating portion all being uniform along an entire length of said fusing roller.

25. The fusing roller of claim 19, said heating portion being made narrower at said end portions than at said center portion, a thickness, a distance between adjacent windings, a pitch and a composition of said heating portion all being uniform along an entire length of said fusing roller.

* * * * *